United States Patent [19]

Schönfeld et al.

[11] Patent Number: 4,997,317

[45] Date of Patent: Mar. 5, 1991

[54] SYSTEM AND METHOD FOR SUPPORTING A MINING GALLERY

[75] Inventors: Burkhard Schönfeld; Erwin Möllmann, both of Melle; Werner Sonntag, Unna-Hemmerde; Siegfried Sell, Datteln; Herbert Niebuhr, Castrop-Rauxel, all of Fed. Rep. of Germany

[73] Assignee: Neuero Stahllau GmbH & Co., Emlichheim, Fed. Rep. of Germany

[21] Appl. No.: 315,884

[22] Filed: Feb. 24, 1989

[30] Foreign Application Priority Data

Feb. 26, 1988 [DE] Fed. Rep. of Germany ..... 3806126

[51] Int. Cl.[5] ..... E21D 11/22

[52] U.S. Cl. ..... 405/288; 405/150

[58] Field of Search ..... 405/288, 146, 150, 151, 405/153

[56] References Cited

U.S. PATENT DOCUMENTS

| | | | |
|---|---|---|---|
| 3,126,708 | 3/1964 | Jasper | 405/288 |
| 3,318,099 | 5/1967 | Sugden | 405/153 |
| 4,252,464 | 2/1981 | Habib | 405/153 |
| 4,459,064 | 7/1984 | Berset | 405/150 X |
| 4,465,404 | 8/1984 | Heintzmann et al. | 405/288 |
| 4,505,622 | 3/1985 | Asszonyi et al. | 405/288 |

FOREIGN PATENT DOCUMENTS 2702672 7/1978 Fed. Rep. of Germany .

*Primary Examiner*—David H. Corbin

*Attorney, Agent, or Firm*—Nils H. Ljungman & Associates

[57] ABSTRACT

A support system is for a longitudinal mining gallery or the like, wherein the gallery is defined by at least a circumferentially extending rock eruption. The support system includes an inner shell including a plurality of wall segments and a plurality of flexible elements. An outer shell of construction material includes a plurality of outer segments between the inner shell and the rock eruption. Each of the wall segments extends circumferentially and includes opposite ends. Each of the wall segments is adjacent a corresponding outer segment of the construction material. At least one of the flexible elements is disposed between adjacent ends of circumferentially adjacent wall segments. The inner shell and the outer shell are circumferentially flexible. The invention also includes a method of supporting the longitudinal mining gallery or the like.

21 Claims, 5 Drawing Sheets

SYSTEM AND METHOD FOR SUPPORTING A MINING GALLERY

BACKGROUND OF THE INVENTION

1. Field of the Invention

This invention relates to a system and method for the supporting of underground mine faces, bunkers and similar cavities in mining, in particular bituminous coal mining.

2. Description of the Prior Art

In underground coal mining, the coal is extracted in the seam by a process which is called stoping. By means of modern extraction equipment, the seam is mined over a width of several hundred meters.

Shearer loaders and coal planers are conventional pieces of extraction equipment. The shearer loader is an oversized milling tool device. Shearer loaders and planers move back and forth along the mining face and shear or plane the coal out of the seam. The mining equipment consequently advances at right angles to the mining face.

The path for the extraction equipment is kept free with a support for supporting the roof. The roof is defined as the rock above the extraction equipment. Conventionally, the support of the extraction equipment, which is being used, is done in steps. For this reason, the support is called a walking support.

In the mining direction behind the support, the roof is no longer supported from below. Therefore, the rock or roof breaks off if particular measures are not taken to fill up the cavity which is formed. The cavity running along the front being mined and protected by the support is called the face.

By means of suitable conveyors, the coal extracted at the face is transported away from the face. The face empties into a so-called gallery. The galleries are defined as the underground path from the face—i.e. from the point where the coal is mined—to the shaft or the bunker. While the face is constantly moving, the galleries remain fixed for a rather long period of time. There are galleries which have remained in the same place for decades. As a rule, the latter are galleries which are used simultaneously for several mining areas or seams.

Galleries which are not as permanent are constructed merely to accompany a face become unimportant as soon as the mining of the face is completed.

The galleries accompanying the face can be constructed along with the face, i.e. the galleries are driven forward at approximately the same rate as the mining. The galleries can also be constructed in advance of the mining.

As soon as the galleries have lost their importance, the galleries are struck. Striking is the term used for the removal of the support in the galleries. In many galleries which accompany the face, the support is struck as the mining of the face proceeds.

As at the face, support is also necessary in the galleries to support the rock overhead. In earlier times, all supports were rigid. That was true both for wooden and for steel supports. Rigid supports have the disadvantage that they are not flexible. For these supports, there are only two alternatives: stand or break. That was a major disadvantage, because frequently peak loads occur in the rock which exceed the stability of the support.

The yielding support was developed many years ago. Yielding supports represented major progress in longwall mining. The idea behind yielding supports was to take advantage of a doming effect in the rock. The doming effect is the ability of the rock to be self-supporting, either in whole or in part. Connected with yielding support was the knowledge that rock movements can be damped by means of a flexible support. The flexible support yields under peak loads, until the peak loads are reduced by the formation of a new dome.

The use of steel profiles represented another step forward in yielding supports. Generally, steel profiles suitable for such an application have the shape of a channel. In particular, yielding support is made possible by the fact that the arch support or, with a closed support, the support ring is made up of individual parts. Generally, an arch support has at least three parts. The individual channels of the arch support overlap one another. In the overlapping region, the channels are pressed together by means of connecting straps with such strength that the friction in the overlapping region is stable under the normal rock pressure, but yields under peak loads. During yielding, the channels are displaced into one another in the direction of the arch.

The dimensions of the support profiles increase with increasing depth. That can be explained easily by the rock pressure which increases with increasing depth. In other words, the support profiles must have a higher moment of resistance corresponding to the increased rock pressure. Moreover, the interval between arch supports decreases with increasing depth. That can also be explained by the increasing rock pressure. In other words, the open space between the individual arch supports, in which the roof is not supported, constantly decreases as the depth increases.

For decades, the open space between the arch supports has been protected with wire mats. Again and again—even at shallow depths—rock strata peel off or release rocks between the individual arch supports. Not only does that present an extreme danger for the miners, but it is also disadvantageous for the support system. Against this background, attempts have been made to protect the space between the arches with the mats.

Such protection systems have a more or less long life span and, depending on the stability of the rock, the protection can be damaged even after a relatively short time. Such damage requires expensive repairs. In the context of this repair work, the space between the arch supports is protected by additional wire mats. Protection can also be achieved by means of a suitable gunite lining, which can be worked into a concrete shell between the arch supports.

The prior art also includes the initial application of a gunite lining to the rock eruption or surface or interface, followed by the installation of the yielding support in the cemented gallery.

With the mats and the gunite, the arch supports in themselves form a more or less closed support. Against this background, it became possible to consider a closed support made of steel. Such considerations were disclosed, for example, in German Patent Publication Published for Opposition Purposes No. 27 02 672, which is incorporated by reference herein. The proposal of the prior art disclosed therein combines an inner steel shell with backfilling. Backfilling in this case includes the application of mortar in the space between the inner steel shell and the rock. However, the solutions of the prior art have the disadvantage that they have not been used so far in actual practice. In the type of support described above, that may be due to the fact that the external concrete shell breaks under the action of a rock movement and the resulting excess load on the support. Then, all that is left is the modest residual strength of the inner steel shell. Recently, no one has grappled with the question of a closed steel support for galleries. This fact is all the more remarkable since, in various mining regions, work is being conducted at increasing depths, and the above-mentioned support problems have become more critical.

OBJECTS OF THE INVENTION

It is an object of the invention to provide a support system and method of support for a gallery including elements that are flexible for controlled yielding under rock movement.

It is another object of the invention to provide such a support system and method which can be adapted to provide overall contact between the rock eruption or surface at the elements thereof.

It is yet another object to provide such a support system and method which is easy and economical to provide and can be readily formed and installed on location within the gallery.

SUMMARY OF THE INVENTION

These and other objects of the invention are provided by a preferred support system which can be used in particular, because it relates to the current planning of which type of support is most suitable, for ever increasing depths. In accordance with this invention, a very advantageous support is achieved, even for great depths, by means of sheet metal segments, which are equipped on the back side—i.e. between steel and rock—with a corresponding segment or segments of construction material, for example, in particular anhydride. Each steel/construction material segment is supported by means of an elastic element on the neighboring steel/construction material segment. A rock movement produces or causes the necessary yielding of the support in accordance with the invention by means of the flexible elements, without the occurrence of damage to the construction material segments.

The flexibility can be advantageously established or set so that not only can be arch be compressed in the circumferential direction but also by buckling of the arch. The elastic or flexible element then forms not only a collapsing body, but also a buckling body. Compared to yielding arch supports of the prior art, the support in accordance with the invention therefore has an additional displacement capability. Of course, a conventional channel profile used as a yielding arch support can also buckle. However, a yielding arch support is damaged after buckling, can no longer be used, and must be replaced.

Finally, another notable advantage of the support in accordance with the invention is that the construction material segment is shaped or formed underground at the installation site. The construction material segment can therefore come into close contact with the rock eruption. The present invention therefore guarantees a force-fit and form-fit at all points. That is not the case with steel supports of the prior art. In the prior art, an attempt is made to solve the problem by means of hoses. The hoses are placed in the conventional channel profile and filled with construction material. The hoses are then expanded to a greater or lesser extent. The purpose of the expansion is to achieve an indirect contact between the channel profile and the rock eruption. However, proper contact is not achieved at all points. As soon as the distance between the rock eruption and the support becomes greater, the hose fails. This is particularly true in the case of jointed rock. Jointed rock is defined as a roof from which the rock has erupted in an irregular fashion. Jointed rock eruptions are caused in particular by blasting as the loose parts of the rock are broken off by the blasting.

The form-fit between the construction material segment in accordance with the invention and the rock eruption can be accomplished in various ways. One possibility is to blow the construction material with a simultaneous wetting with water into the cavity between the steel segments and the rock eruption after the steel segments have been erected. In this case, there need not be any formwork, if the construction material has an appropriate early strength or firm consistency. Such mortars or construction materials are part of the prior art in the mining industry and well known to those skilled in the art of mining.

Another possibility for shaping the construction material segments according to the invention is by the use of an end form. The construction material can be hydraulically pumped behind the end form. The end form prevents the construction material from flowing back out of the cavity between the steel segments and the rock eruption.

In accordance with the present invention, the flexible elements remain free of the construction material both when the construction material is injected in place or when it is applied hydraulically. In other words, a cavity is retained in the vicinity of the flexible elements. It is thereby advantageous to provide a formwork in this area to protect the cavity.

Preferably, the cavity in the vicinity of each flexible element extends from the flexible element to the rock eruption The cavity can also end at some distance from the rock eruption. However, the cavity is always made large enough so that the elastic action described herein is essentially retained.

Overall, many aspects of the support system in accordance with the invention may be varied. Adaptations can be made to satisfy special requirements in specific cases. The alteration or adjustment of the support in accordance with the invention can be done optionally provided by changing the number of different segments and/or by changing the number of the flexible elements. The support can be provided and used as a modular system.

Because of its defined flexibility, the support in accordance with the invention is able to counteract convergence phenomena in mining. As a result of the preferred full-surface contact between the segments and the rock eruption, forces of a defined magnitude and direction can be directed at the appropriate time against the rock pressure. The support in accordance with the invention can be used in an optimal fashion or manner to counteract a doming effect.

Common convergence phenomena include upheavals (an upheaval of the floor of the gallery). In such a case, the rock forming the gallery floor is lifted up into the gallery by the pressure of the surrounding rock. But convergence can also be defined as any other rock movement directed into the gallery.

In accordance with the invention, corrugated steel sheets are preferably used as the sheet steel segments. When corrugated, steel sheet has a particularly high resistance to bending. It is also advantageous to provide the steel sheet with construction material anchors or reinforcing rods, which both provide a connection to the construction material segment and can also optionally act as a reinforcement of the construction material segment.

The preferred flexible elements can include plates, between which are disposed deformation profiles. The deformation profiles can be designed mathematically and structurally to provide precisely the desired flexibility.

Optionally, several groups of deformation profiles can be placed on top of one another. The groups can follow the radius of curvature of the support. In other words, the groups may then be located on a radius of curvature.

Generally, the objects of the invention are provided by a preferred support system for a longitudinal mining gallery or the like, wherein the gallery is defined by at least a circumferentially extending rock eruption. The support system includes an inner shell including a plurality of wall segments and a plurality of flexible elements. An outer shell of construction material includes a plurality of outer segments between the inner shell and the rock eruption. Each of the wall segments extends circumferentially to include opposite ends. Each of at least some of the wall segments is adjacent to at least a corresponding one of the outer segments of the construction material. At least one of the flexible elements is disposed between adjacent ends of circumferentially adjacent wall segments. The inner shell and the outer shell are circumferentially flexible.

The objects of the invention are also provided by a preferred method of supporting a longitudinal mining gallery or the like, which gallery is defined by at least a circumferentially extending rock eruption. The method includes the steps of erecting at least one generally arcuate support of a plurality of supports for forming an inner shell in the gallery; the erecting the at least one generally arcuate support including joining a plurality of circumferentially extending wall segments with at least some flexible elements therebetween; forming an outer shell of construction material including a plurality of outer segments between the inner shell and the rock eruption; the forming including locating at least some of the outer segments adjacent the wall segments; and the forming including providing a collapsible space adjacent at least some of the flexible elements between circumferentially adjacent outer segments.

With regard to other configurations and features of the support in accordance with the invention and the flexible elements thereof will be disclosed in the accompanying drawings and the following description.

DESCRIPTION OF THE PREFERRED EMBODIMENTS

Figure 1C:
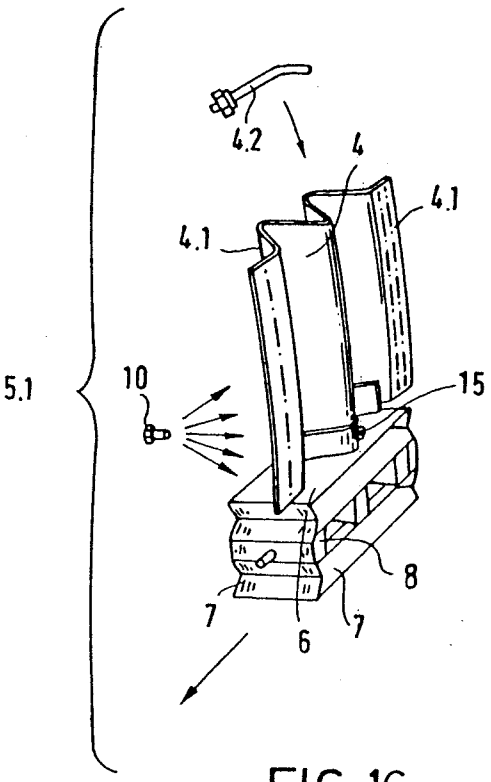
FIG. 1 is a schematic end view of an overall representation of a preferred support system in accordance with the invention within a gallery and including an enlarged fragmentary perspective view of specific portions of the preferred support system.
Figure 1B:
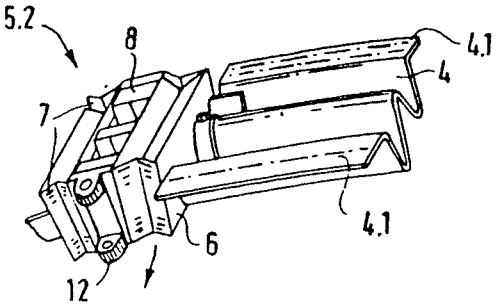
Figure 1:
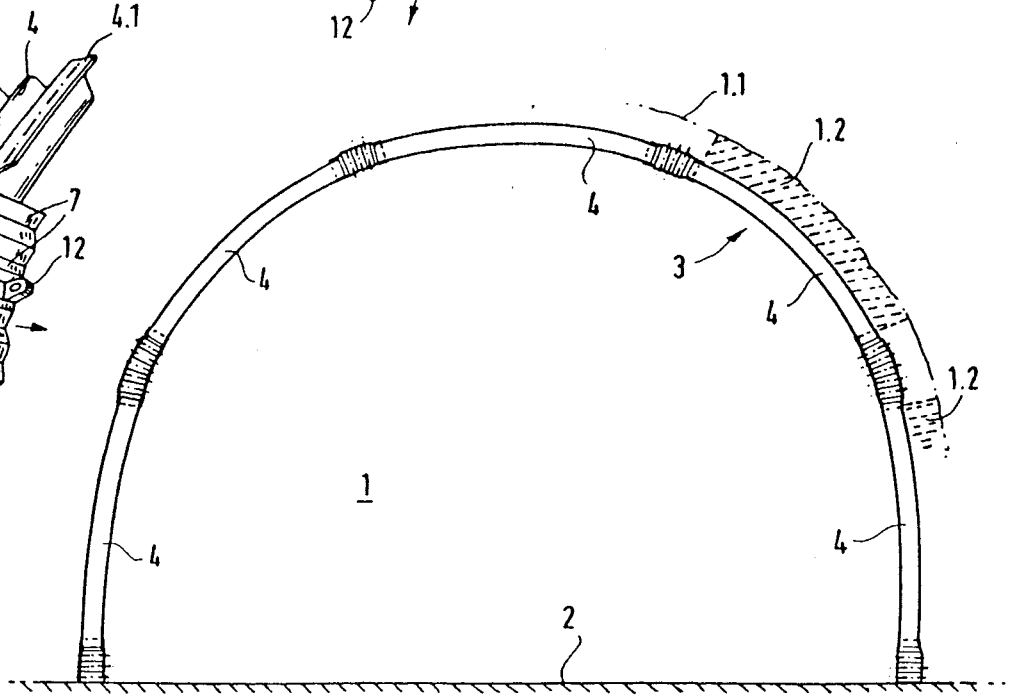

As seen in FIG. 1, a typical mine gallery 1 includes a gallery floor 2. The rock eruption or surface or interface is indicated by dotted lines at 1.1. The gallery support 3 comprises an approximately closed steel inner shell and an outer shell of molded segments 1.2 of anhydride of a type which is well known in the mining art. Instead of anhydride, any other mining cement, also well known, could be used.

Each support 3 of the preferred closed inner shell is comprised in the circumferential direction of the gallery 1 of five sheet metal segments 4, which are formed of corrugated steel sheet which is about 2–5 mm thick. In the longitudinal direction of the gallery, steel segments 4 are installed one behind the other. As will be seen, the number of steel segments can vary both in the longitudinal and circumferential direction of the gallery. For the segments 4 to be installed in series longitudinally through the gallery, they are each provided beveled edges 4.1, by means of which they overlap one another in the longitudinal direction of the gallery. As seen in the illustrated embodiment, there is a bolted connection in the overlapping region. The nuts of such bolted connections would preferably be located on the inside of the arched support, so that the bolted connection could be removed from the inside of the gallery. This is an advantage when it comes to striking the gallery. Instead of threaded bolts and nuts, screws 10 can also be used. The preferred screws 10 traverse a hole in the one edge 4.1 and can be screwed into a threaded hole in the edge 4.1 behind it. In other embodiments, keyed or bolted connections could also be used. The individual connections are preferably uniformly distributed over the circumference of the support and each segment 4 thereof.

On the rock side, the segments 4 are equipped with a number of preferably, substantially uniformly distributed construction material anchors 4.2. The construction material anchors 4.2 can be optionally inserted, welded or bolted into the segment 4. In number, type, size and style of such construction material anchors which are well known in the mining field may be employed. On the exposed end, facing away from the segment 4, the construction material anchors 4.2 will preferably have a bevel. The construction material anchors 4.2 are used to secure the connection or to make the connection between the molded segments 1.2 and the metal segments 4. That is true in particular for segments 4 with a relatively smooth surface.

Between the segments 4 there are preferably provided flexible elements 5.1, 5.2 and 5.3. The flexible elements 5.1 are located on the floor, the flexible elements 5.3 in the side walls (lateral region of the arch), and the flexible elements 5.2 in the vicinity of the roof.

Although the preferred molded segments 1.2 may or may not extend beyond the length of the segments 4, the molded segments 1.2 are preferably limited in the circumferential direction in order to leave the area of the flexible elements 5.1, 5.2 and 5.3 free. The segments 1.2 are preferably manufactured individually for each arch support of the preferred support system. This may be done by injecting an appropriately wetted mortar, after the erection of an arch support 3, at the end thereof into the cavity between the rock eruption 1.1 and the segment 4, while leaving exposed or open areas at the flexible elements. In one accepted method, the construction material is in the form of a powder or granulate and is injected dry with water being added at the outlet of the injection line. The process is completed when each cavity is filled, and the next arch support, consisting of segments 4 and flexible elements 5.1, 5.2 and 5.3, can be erected. At that time, the segments 1.2 for the newly-erected arch support are fabricated. It should be noted that segments 4 for several arch supports 3, one behind the other in the longitudinal direction of the gallery, can also be fabricated simultaneously.

Advantageously, an increasing layer of construction material is formed as the support system progresses, over all the segments 4 as the support structure proceeds in the longitudinal direction of the gallery. The layer of construction material distributes loads which are directed at a single segment 4 to the arches of several neighboring segments 4.

Instead of the injection technique described above, any other backfilling technique well known in the mining art can also be used, including hydraulic backfilling. For hydraulic backfilling, a mobile end form is appropriate for the arch supports.

Each segment 4 in the embodiment has a corresponding segment 1.2. The segments 1.2 form an outer shell, which is interrupted in the vicinity of each of the flexible elements 5.1, 5.2 and 5.3. In the case of a rock movement, each segment 4 with its segment 1.2 can yield to the rock movement until, by distribution of the load on neighboring arch supports or segments, a sufficient total resistance is achieved to stabilize the movement of the rock. This feature is connected with a new dome action which is building up in the rock.

The support of large loads, for example, concrete rail monorails, is preferably done on the flexible elements, in molded lugs, among other things. The suspension of lighter loads, for example, power lines, can also be done on the construction material anchors, which project through the segments 4 into the gallery.

In contrast to conventional yielding arch supports, the support 3, in accordance with the invention, can not only yield in the circumferential direction of the segments 4, but can also be deformed inwardly, if necessary. When the illustrated support yields, with the compression of the flexible elements, the cavity behind the flexible elements becomes smaller. In the extreme case, the segments 4 can yield to a rock movement until the elasticity of the flexible elements has been completely exhausted.

Optionally, the cavity provided in the flexible elements for elasticity can be protected during the fabrication of the segments 1.2 by means of inflatable cushions. The cushions are placed for the backfilling process in the cavity between the flexible elements and the rock eruption or interface 1.1 and inflated. The cushions thereby prevent the penetration of anhydride or other construction materials in this region. After setting of the anhydride, the air can be released, and the cushions removed from the cavity and used for the next arch support.

To form the deformable cavity or collapsible space, other bodies can also be used, for example, hollow bodies of wood, steel or plastic. The hollow bodies can function as a lost form. In other words, the formwork then remains at the site where it was used. Optionally, the formwork for the cavity formation can also be integrated with the flexible elements or can be attached to them. When using flexible elements with a steel sheet structure, the formwork for the cavity between two forms forming segments 1.2 which are adjacent in the circumferential direction can, for example, be a shaped piece of sheet metal.

Figure 2:
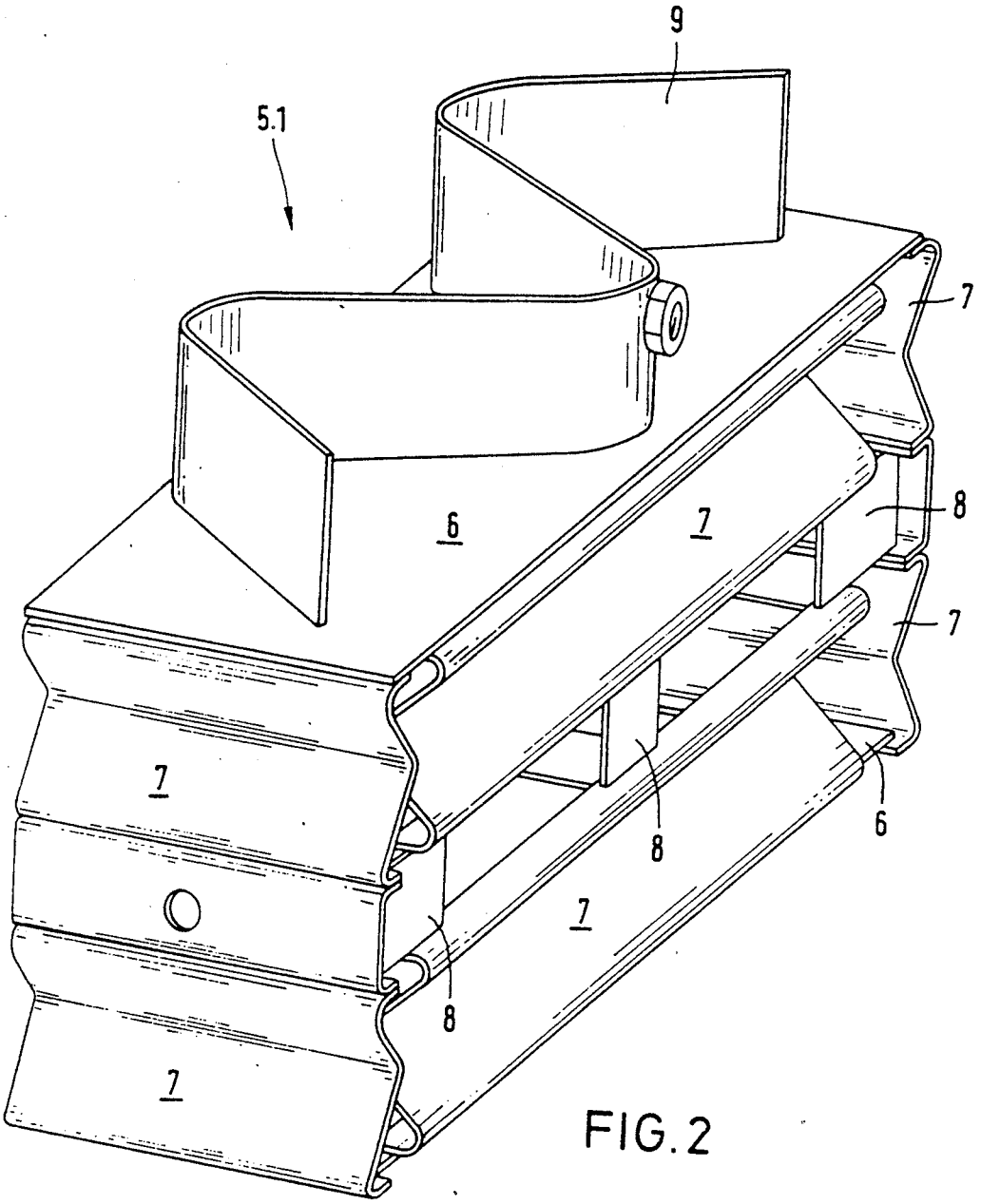
FIG. 2 is a perspective view of the flexible element 5.1 as illustrated in FIG. 1.
Figure 3:
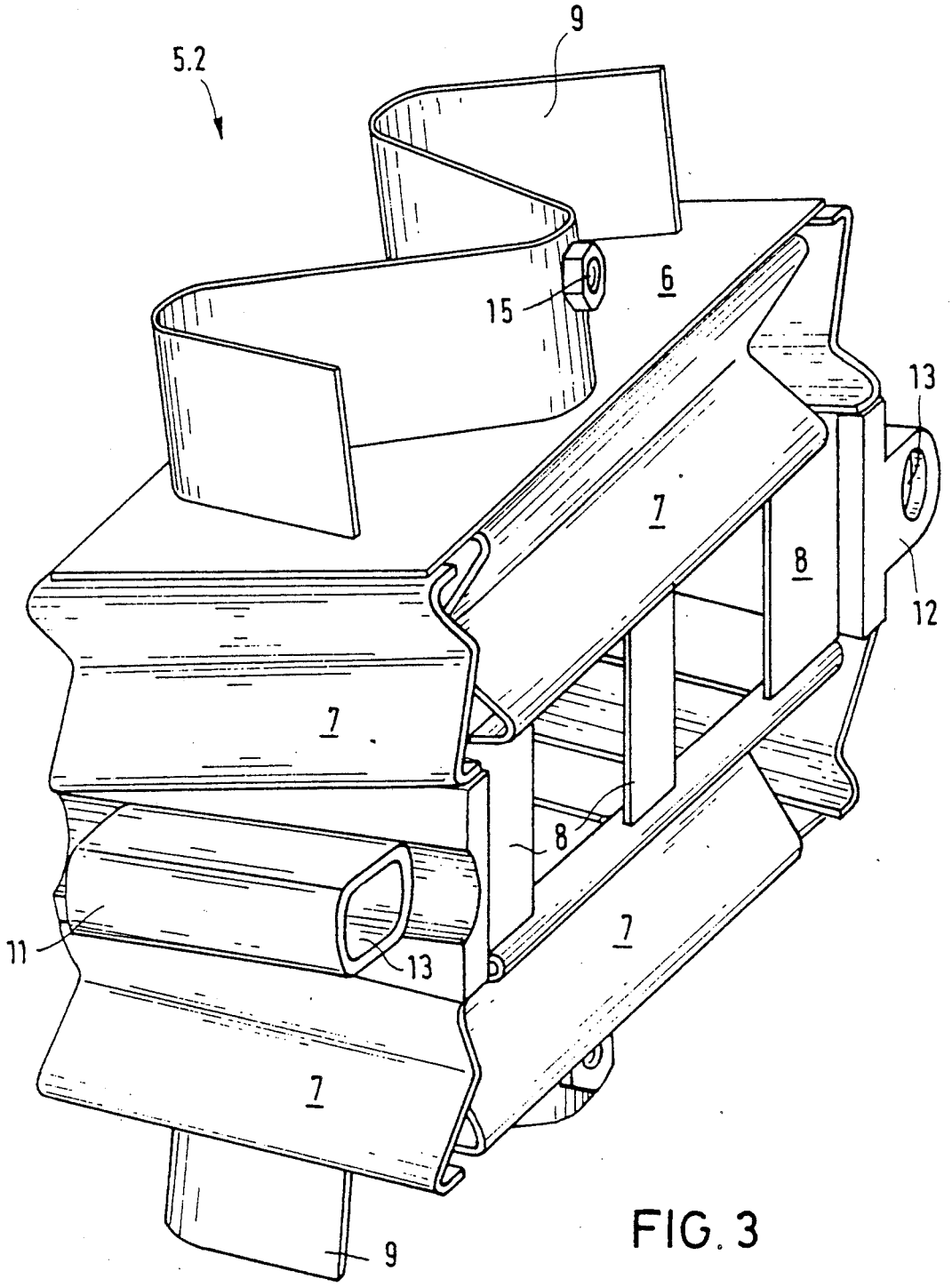
FIG. 3 is a perspective view of the flexible element 5.2 as illustrated in FIG. 1.
Figure 4:
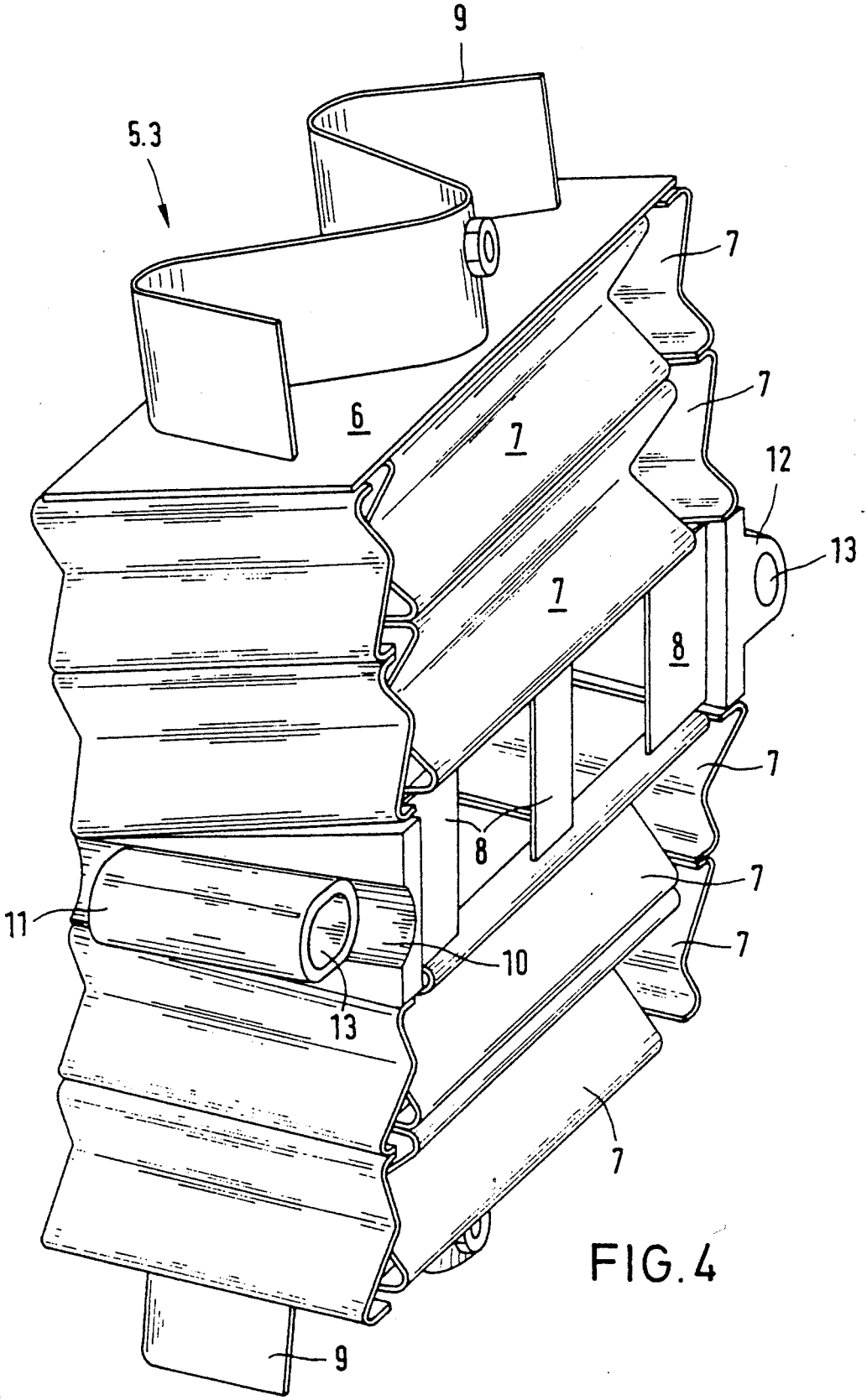
FIG. 4 is a perspective view of the flexible element 5.3 as illustrated in FIG. 1.

As respectively shown in detail in FIGS. 2 through 4, the flexible elements 5.1, 5.2 and 5.3 have, in the circumferential direction, plates 6 opposite one another, between which there are deformation profiles 7. The deformation profiles 7 extend, in the preferred embodiment, both in the longitudinal direction and in the transverse direction of the elements. The deformation profiles 7 optionally have a cross section which is essentially in the shape of an "M" or "W". The cross section, the material used and other parameters which determine the deformation behavior of the profiles 7 can vary. All the parts of the flexible elements consist of steel sheet, which is preferably up to about 5 mm thick.

For the flexible element 5.1 in the floor region shown in FIG. 2, the deformation profiles 7 are in two levels above one another. In each level there are preferably four deformation profiles 7. The lower deformation profiles 7 are connected with the deformation profiles 7 on top of them by linear support beams 8. The length of the support beams 8 can also have an effect on the flexibility of the flexible element 5.1.

In the embodiment illustrated in FIG. 3, there are again two levels with deformation profiles 7 for the flexible elements 5.2 located in the roof region. In each level there are again provided four deformation profiles 7, corresponding to the structure illustrated in FIG. 2. In contrast to the structure illustrated in FIG. 2, however, on the outside of the flexible element 5.2, there are support beams 8 which are longer than those on the inside. Therefore, the two levels with the deformation profiles 7 are at an angle to one another. The angular position is appropriate to the corresponding radius of curvature of the arch support in the roof region.

In addition, the flexible elements 5.2 differ from the flexible elements 5.1 by the inclusion of coupling bodies 11 and 12 with insertion openings 13. While the coupling body 11 is formed by a single, centrally located tube segment, the coupling body 12 is formed by two tube segments, only one of which can be seen in FIG. 3, which are separated to be located at some distance from one another. The two tube segments of the coupling body 12 are at a distance which equals or corresponds to the length of the coupling body 11. Consequently, a coupling body 11 of one flexible element can be encircled by or surrounded by the coupling body 12 of a neighboring flexible element with some clearance. The insertion openings 13 of each coupling body 11, 12 are aligned and are located accordingly, so that bolts can be inserted therein to produce a connection of the support arch to the adjacent flexible elements 5.2. It should be clear to those skilled in the mining art that, instead of bolts, screws and other connection elements can also be used. Other types of connections between the flexible elements can also be considered.

The flexible element 5.3 illustrated in FIG. 4 differs from the flexible element 5.2 illustrated in FIG. 3 in that there are several groups of deformation profiles 7. In other words, above the connection web 8, there are two levels of deformation profiles 7. There is the same arrangement of connected, double deformation profiles 7 in each plane. Still further, there are also two similar levels with uniformly distributed deformation profiles 7 below the connection web 8.

All of the flexible elements 5.1, 5.2 and 5.3 have in common the fact that they include retaining profiles 9.

On the flexible elements 5.1 standing upright on the floor, there is a single retaining profile 9. The other flexible elements 5.2 and 5.3 have two retaining profiles 9. The retaining profiles 9 are on the surfaces 6 and are used to establish the connection with the metal segments 4 and have a corresponding corrugated shape. In the preferred embodiments, the segments are inserted into contact and alignment with the retaining profile 9 from the inside of the gallery. When properly inserted, the segments can be bolted to the retaining profiles 9 at 15 although it should be clear that other types of connections are also possible.

Figure 5:
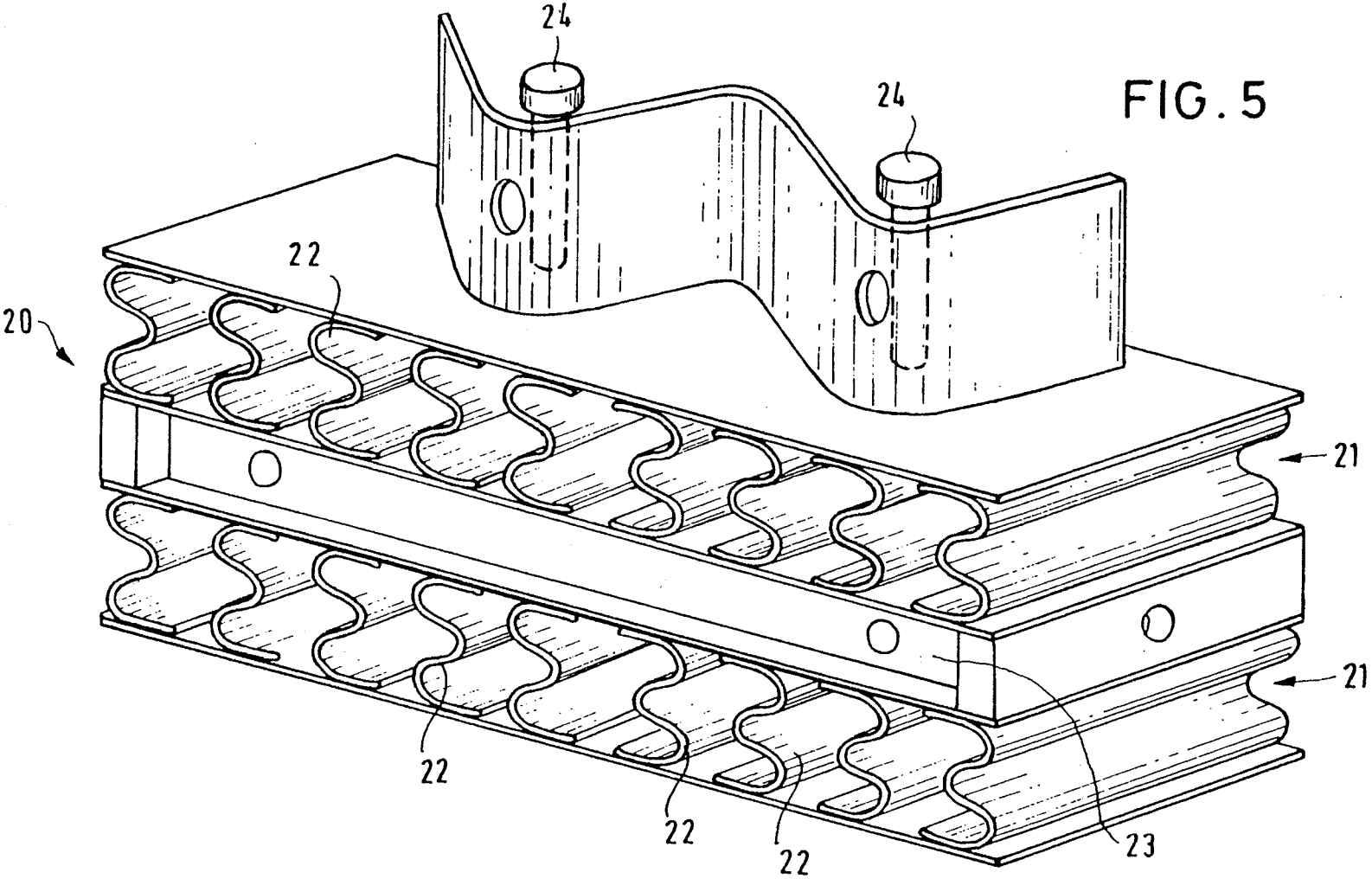
FIG. 5 is a perspective view of an alternative flexible element including various features of the invention.

As seen in FIG. 5, an alternative flexible element 20 can be used instead of the element 5.1. The element 20, in contrast to the element 5.1, absorbs larger thrust forces, such as can occur during an extreme movement. Such extreme movement can be the result of an impact, for example, in the case of a rock deformation running approximately horizontal, and at right angles to the longitudinal direction of the gallery.

To absorb the larger thrust forces, there are preferably provided, for example, nine W-shaped deformation profiles 22 in each level 21, which run radially to the cross section of the gallery. The deformation profiles 22 of level 21 are connected to one another by means of a closed box 23, instead of by webs 8, which forms an abutment for each deformation profile 22.

Reinforcement bolts 24 are also provided behind the retaining profile of the flexible element 20. The armor or other types of bolts can be employed to make a connection between the flexible element and the construction material segment 1.2, which improves the resistance to thrust forces.

Instead of the flexible elements 5.2 and 5.3, alternative elements can be used which are constructed similar to the element 20.

For the erection of the segments 4 and flexible elements therebetween in accordance with the invention, the use of manipulator or support platforms common in mining is advantageous. These support platforms are equipped with hydraulically movable gripper tools, by means of which the segments and flexible elements can be positioned. These support platforms also have appropriate working platforms, the height of which can be adjusted, for the miners.

In summary, the preferred closed support is for underground mine galleries and similar cavities and include an inner shell of steel sheet segments, which are flexible in the circumferential direction, and an outer shell of construction material. The steel inner segments are provided with construction material outer segments. Each combined steel/construction material segment 4, 1.2 is supported by means of flexible elements 5.1, 5.2, 5.3 on the other steel/construction material segment.

The flexible elements are also flexible to buckling. Behind each of the flexible elements 5.1, 5.2, 5.3 is a deformation cavity between the construction material segments 1.2.

The inner shell includes a plurality of arch supports 3 which are connected to one another by means of the flexible elements 5.1, 5.2, 5.3 and/or by means of the segments 4. For example, there may be included coupling bodies between the flexible elements of neighboring arch supports with screws and/or bolts and/or tube segments 11 or lugs 12 serving as the coupling bodies.

A shell may be employed to form the deformation cavity or collapsible space behind the flexible elements and may employ reusable or lost formwork. The forms may be attached to the flexible elements 5.1, 5.2, 5.3 or integrated with them. Still further, inflatable cushions may be used as the formwork.

The flexible elements may have M-shaped or W-shaped deformation profiles which may be arranged in groups. Deformation profiles at right angles to and/or along the gallery may belong to the same group. Still further, several groups of deformation profiles 7 may be located above one another. There may also be included webs 8 or boxes 23 located between the deformation profiles. For some flexible elements, the webs or box surfaces located on the inside may be shorter than the webs or box surfaces located on the outside.

Generally, the preferred flexible element may be characterized by different moments of resistance of the groups of deformation profiles 7 and/or of the webs 8 and/or boxes 23.

Retaining profiles 9 may be employed on the flexible elements for the connection of the segments 4. One skilled in the mining art may utilize reinforcing bolts 24 on the flexible elements reinforcing rods and/or construction material anchors on the segments 4; and/or a load suspension on the flexible elements.

A number of U.S. Patents disclose various methods, devices and structures for supporting galleries, tunnels, or the like and are listed by number and title as follows:

| U.S. Pat. No. | TITLE |
|---|---|
| 3,885,395 | UNDERGROUND MINING ARCH GATEWAY SYSTEM |
| 4,072,018 | TUNNEL SUPPORT STRUCTURE AND METHOD |
| 4,100,749 | METHOD AND DEVICE FOR LINING CHAMBERS AND GALLERIES |
| 4,114,386 | METHOD AND DEVICE FOR REMOVING RESILIENT GALLERY LINING FRAMES IN MINING AND TUNNELLING WHICH CONSIST OF A NUMBER OF SECTION SEGMENTS INSERTED ONE INTO ANOTHER IN A DISSIMILAR MANNER |
| 4,187,037 | WALL SUPPORTING ARRANGEMENT, ESPECIALLY FOR SUPPORTING MINE GALLERY |
| 4,261,670 | PROCESS FOR THE PROTECTION OF GALLERIES |
| 4,302,133 | DEVICE FOR SUPPORTING A GALLERY OR A TUNNEL |
| 4,309,059 | MINING METHOD |

These patents are expressly incorporated by reference as if the contents thereof were set forth in full herein.

The invention as described hereinabove in the context of a preferred embodiment is not to be taken as limited to all of the provided details thereof, since modifications and variations thereof may be made without departing from the spirit and scope of the invention.

What is claimed is:

1. A support system for a longitudinal mining gallery or the like, wherein said gallery is defined by at least a circumferentially extending rock eruption, said support system comprising:

an inner shell including a plurality of wall segments and a plurality of flexible elements;

an outer shell of construction material including a plurality of outer segments between said inner shell and said rock eruption;

each of said wall segments extending circumferentially to include opposite ends;

each of at least some of said wall segments being adjacent to at least a corresponding one of said outer segments of said construction material;

at least one of said flexible elements being disposed between adjacent said ends of circumferentially adjacent said wall segments; and said inner shell and said outer shell being circumferentially flexible.

2. The support system according to claim 1, wherein each of said flexible elements is capable of circumferentially buckling.

3. The support system according to claim 1, wherein adjacent ones of said outer segments are separated by a collapsible space therebetween and said collapsible space is adjacent one of said flexible elements.

4. The support system according to claim 1, wherein said wall segments and said flexible elements therebetween which are circumferentially aligned combine to form an arcuate support.

5. The support system according to claim 4, wherein longitudinally adjacent ones of said arcuate supports are connected by at least one of longitudinally adjacent ones of said wall segments and longitudinally adjacent ones of said flexible elements.

6. The support system according to claim 5, wherein said longitudinally adjacent flexible elements are connected by coupling means therebetween and said coupling means includes at least one of screw means, bolt means, tube segments, and lugs.

7. The support system according to claim 1, further including space defining means adjacent said flexible element during formation of said collapsible space between said adjacent ones of said outer segments and said space defining means includes at least one of reusable formwork, lost formwork, and inflatable cushion means.

8. The support system according to claim 7, wherein said space defining means is integrally formed with said flexible element.

9. The support system according to claim 1, wherein said flexible elements include deformable profiles having at least one of an M-shape and a W-shape.

10. The support system according to claim 9, wherein said deformable profiles are arranged in a group with at least one of said deformable profiles of said group being disposed perpendicular to at least another of said deformable profiles of said group.

11. The support system according to claim 9, wherein said deformable profiles are arranged in at least two of said groups which are circumferentially spaced one from the other.

12. The support system according to claim 11, wherein said flexible elements includes at least one of webs and boxes between said two groups of said deformable profiles.

13. The support system according to claim 12, wherein said at least one of webs and boxes at an inside of said flexible element is smaller in a circumferential direction than said at least one of webs and boxes at an outside of said flexible element.

14. The support system according to claim 1, wherein said wall segment is formed of sheet steel material and includes at least a curved transverse profile for reinforcement against compression in a circumferential direction.

15. The support system according to claim 14, wherein each of said flexible elements includes a retaining profile for connection with said end of said wall segment.

16. The support system according to claim 1, wherein said inner shell includes at least one of reinforcing bolts on at least some of said flexible element, reinforcing rods on at least some of said wall segments, and construction material anchors on at least some of said wall segments.

17. The support system according to claim 1, wherein said flexible element includes load suspension means.

18. A method of supporting a longitudinal mining gallery or the like, which said gallery is defined by at least a circumferentially extending rock eruption, said method comprising the steps of:

erecting at least one generally arcuate support of a plurality of supports for forming an inner shell in said gallery;

said erecting said at least one generally arcuate support including joining a plurality of circumferentially extending wall segments with at least some flexible elements therebetween;

forming an outer shell of construction material including a plurality of outer segments between said inner shell and said rock eruption:

said forming including locating at least some of said outer segments adjacent said wall segments; and said forming including providing a collapsible space adjacent at least some of said flexible elements between circumferentially adjacent ones of said outer segments.

19. The method according to claim 18, wherein said forming includes at least one of injecting and molding said construction material in liquid form and allowing said construction material to harden and said providing said collapsible space includes preventing said construction material in said liquid form from entering said collapsible space.

20. The method according to claim 18, further including the step of connecting adjacent ones of said supports together.

21. The method according to claim 18, further including the step of anchoring at least some of said wall segments to said outer segments during said forming of said outer shell.

* * * * *

UNITED STATES PATENT AND TRADEMARK OFFICE

CERTIFICATE OF CORRECTION

PATENT NO. : 4,997,317

DATED : March 5, 1991

INVENTOR(S) : Burkhard SCHÖNFELD, et al.

Figure 1A:
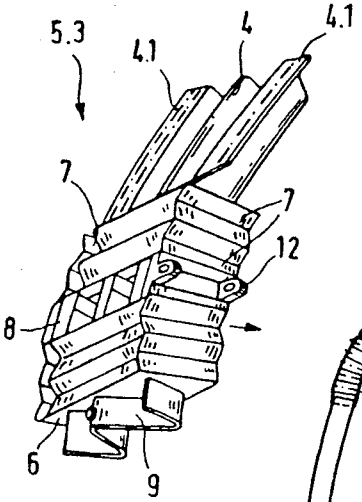

It is certified that error appears in the above-identified patent and that said Letters Patent is hereby corrected as shown below:

In column 5, after line 60, insert the following:

-- Figure 1a is an enlarged fragmentary perspective view of a specific portion of the preferred support system.

Figure 1b is another enlarged fragmentary perspective view of a specific portion of the preferred support system.

Figure 1c is yet another enlarged fragmentary perspective view of a specific portion of the preferred support system.--

In column 6, line 3, after 'FIG.1,', insert --1a, 1b and 1c,--.

In column 10, line 23, after 'elements', insert --;--.

Signed and Sealed this

Fifteenth Day of September, 1992

*Attest:*

DOUGLAS B. COMER

*Attesting Officer*

*Acting Commissioner of Patents and Trademarks*